United States Patent [19]

Lynch

[11] 4,014,229

[45] Mar. 29, 1977

[54] FILM DISPENSER AND CUTOFF

[75] Inventor: William C. Lynch, Brecksville, Ohio

[73] Assignee: Clamco Corporation, Cleveland, Ohio

[22] Filed: Mar. 21, 1975

[21] Appl. No.: 560,814

[52] U.S. Cl. ..... 83/16; 83/171; 53/390

[51] Int. Cl.[2] ..... B26D 7/10

[58] Field of Search ..... 83/16, 171; 53/390

[56] References Cited

UNITED STATES PATENTS

| | | | |
|---|---|---|---|
| 2,437,295 | 3/1948 | Eastwood | 83/171 |
| 3,245,294 | 4/1966 | Butter et al. | 83/171 X |
| 3,465,627 | 9/1969 | Vigneault | 83/171 |
| 3,754,489 | 8/1973 | Carver, Jr. et al. | 83/16 |
| 3,782,615 | 1/1974 | Webster et al. | 83/171 X |

*Primary Examiner*—Willie G. Abercrombie

[57] ABSTRACT

Wrapping apparatus including a film cutoff element. The cutoff element being an internally heated rod-type heating unit having an external periphery designing a corner edge. The element is maintained at a temperature below the melting point of the plastic film to be severed by a thermostat which energizes and deenergizes the cutoff element in dependence upon the temperature of the cutoff element. A bimetal thermostat in good heat transferring relationship with the cutoff element is utilized to control the energization of the heating element.

14 Claims, 3 Drawing Figures

FILM DISPENSER AND CUTOFF

The present invention relates to a wrapping apparatus for wrapping plastic film products, such as polyvinal chloride wrapping film, and more particularly to a cutoff therefor.

Wrapping apparatus having a roll of film such as polyvinyl chloride film for wrapping packages have heretofore used a hot-wire cutoff to sever the desired sheet from the roll. While a hot-wire cutoff severed the film satisfactorily and cleanly, there has been concern about fumes from such cutoffs and, accordingly, various attempts have been made to provide a cutoff which did not result in fumes.

One such attempt is shown in U.S. Pat. No. 3,754,489 in which an attempt is made to minimize fumes by moving the sheet against a rectangular cutoff element which is heated to a temperature of between 325° and 350° F. The rectangular cutoff wire in accordance with the teaching of this patent is to be maintained at a substantially constant temperature along the line of cutoff during the severing operation and the cutoff element is provided with a substantial mass which provides a heat sink to maintain such temperature constant during severing. The power supply in this patent continuously energizes the cutoff element with about 6.8 amperes of current.

Another approach in the industry has been to lower the temperature of the cutoff element having a round cutoff surface against which the film is moved to about 275° to effect a severing of the film as the temperature softens the plastic.

The described approaches have not been able to minimize the fumes to the extent desired and also provide a good line of severance of the plastic film.

Applicant has found that film can be severed along a clean line and the temperature of the cutoff lowered to a point (preferably 240°–260°) where polyvinyl film will not melt or fume by providing a cutoff element which has a corner edge against which the film is severed and by providing a relative high capacity for the element which is switched on and off depending on the temperature of the cutoff element. The element preferably is a metal tube having an internal electrical heating element and a corner edge formed by the intersection of two substantially planar external surfaces of the element. The corner edge functions to concentrate the stresses applied to the film substantially along the line of severance. In addition, the cutoff element preferably has associated therewith a thermostat which senses the temperature of the element and switches the power to the heating element on and off, depending upon the temperature of the cutoff element. While the thermostat will switch the power to the element on and off to keep the edge at the desired temperature for severing, the temperature of the corner edge which engages the plastic film will drop during the severing operation because of the heat withdrawn by the severing operation from the edge. However, the edge will rapidly reheat after the severing due to the thermostat which will switch on when necessary to bring the cutoff element back to the desired temperature for the severing.

The resulting cutoff is such that a clean severance of the plastic film can be effected and no significant fumes will result.

At temperatures of 240° to 260°, the plastic film may actually lie against the cutoff element and will not fume or melt.

One of the advantages obtained by using a temperature sensing element which directly senses the temperature of the cutoff element is that the heating element will not overheat even though the amperage of the electrical heater and its heating capacity is capable of raising the temperature to a level considerably higher than that desired. When several sheets are severed in a rapid sequence the electrical current applied to bring the temperature of the edge up to proper temperature can be relatively large to effect a fast response without overheating the cutoff element since the temperature sensing element will switch the power off to maintain the proper temperature once it is reached.

Further advantages and features of the present invention will be understood from the following detailed description of a preferred embodiment thereof made with reference to the accompanying drawings forming a part of the present specification for the subject matter disclosed therein and in which.

Figure 1:
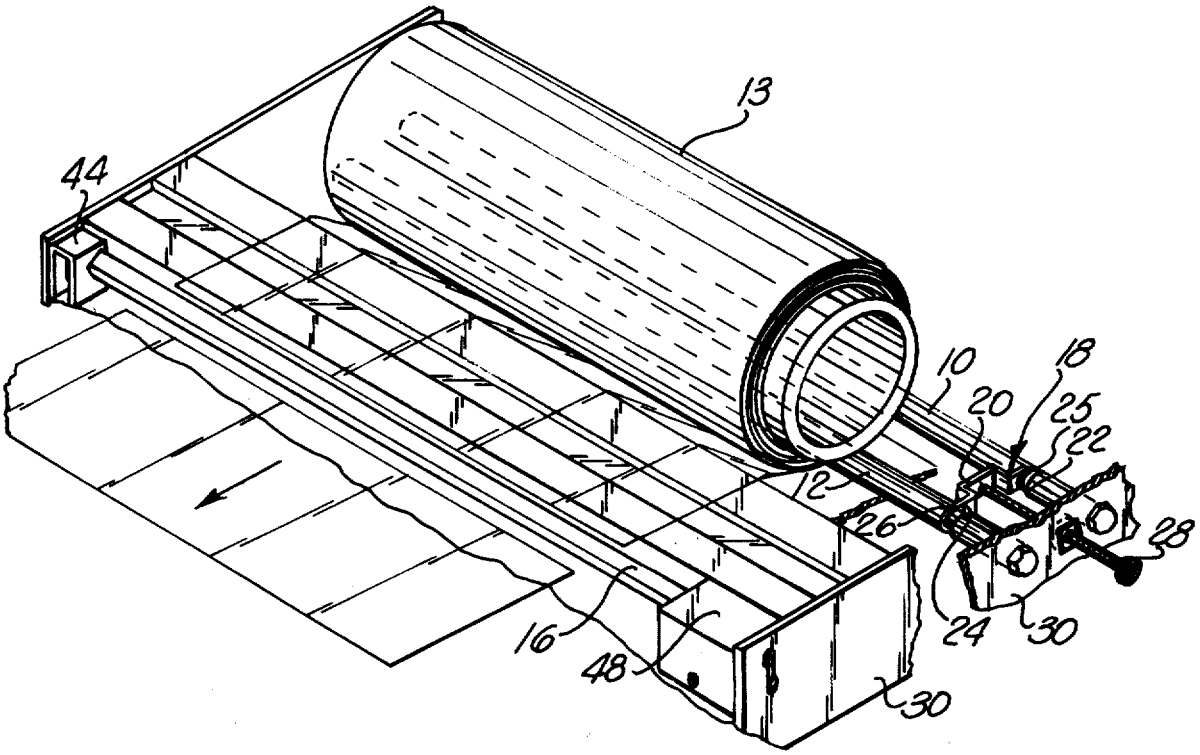
FIG. 1 is a fragmentary orthogonal view showing a film dispenser embodying a cutoff of the present invention.

Referring to FIG. 1, the wrapping apparatus shown therein has a pair of rollers 10, 12 which support a roll of plastic film 13 such as polyvinyl chloride film, to be used in wrapping various products. The plastic film may be drawn from the underside of the film roll 13, i.e. the side which rides on the rollers 10, 12, forwardly over a flat, shelf-like support, which forms a wrapping table for articles to be wrapped. A cutoff element 16 which preferably has a rectangular cross-sectional shape, is mounted forwardly of the wrapping table, preferably a little below the height of the wrapping table.

To effect severing of wrapping film from the roll the film is drawn forwardly from the film roll until the desired line of severance is over the cutoff element 16. The film is then moved downwardly against the element to effect severance.

The rollers 10, 12 upon which the film roll 13 is supported, has a drag brake 18 which applies a drag force to the rollers 10, 12 so that the film must be drawn from the film roll 13 against the braking resistance of the brake 18, causing tension in the film. This resistance is sufficient to enable the tensioned film to be drawn downwardly against the cutoff element 16 with pressure without the film being drawn from the roll 13 during the severing operation.

The brake 18 comprises a bracket 20 having end portions 22, 24 received in circumferential grooves 25, 26 in the rollers 10, 12 respectively. The end portions 22, 24 bear against the sides of the grooves 25, 26 respectively, to apply a frictional drag force against the rollers to prevent the rollers from rolling freely. The force which is applied by the end portions of the bracket 20 is adjustable by turning a threaded member 28 which threads through an end support 30 for the rollers 10, 12 and is fixed to the bracket 20 so as to be rotatable therein but constrained against axial movement relative thereto. Threaded member 28 may be rotated in the threaded aperture in the end support member 30 to adjust the frictional drag applied by the bracket 20. The drag brake 18 is a conventional and known brake.

Figure 2:
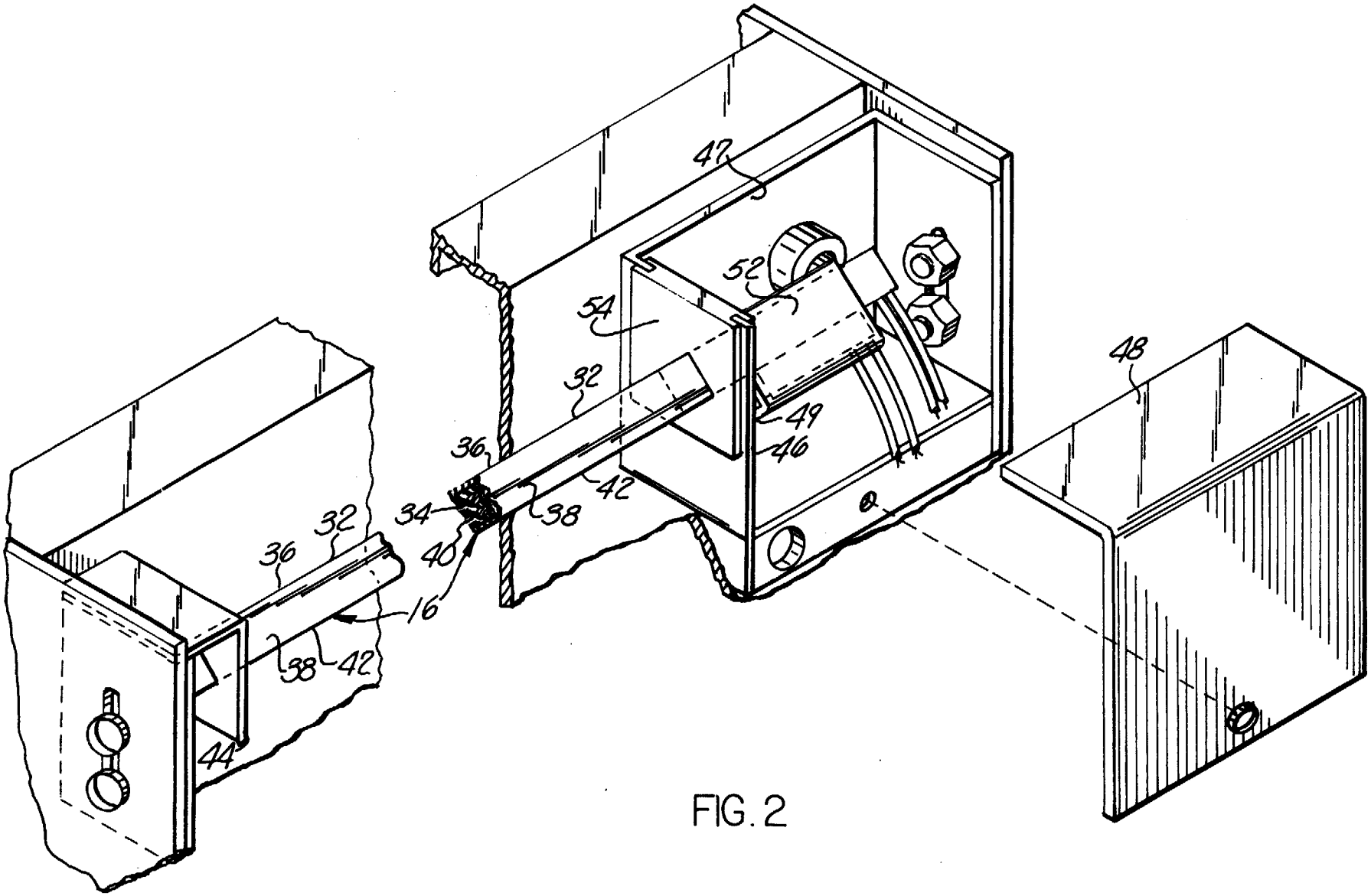
FIG. 2 is a fragmentary respective view, which has been enlarged, of a portion of the film dispenser of FIG. 1, to better show the cutoff element.

As is best shown in FIG. 2, the cutoff element has an edge 32 formed by two adjacent sides which in the preferred embodiment are disposed at about 90° with respect to each other and is mounted to present the edge to the film as the film is drawn downwardly against the cutoff element. This edge concentrates the forces applied to the film by the element to act substantially along the line of severance.

The cutoff element is preferably a tubular metal element which has an internal heating element 34 electrically insulated from the tube and which extends substantially the full length of the cutoff element to provide the necessary heat for heating the cutoff element including the corner edge 32.

In the illustrated preferred embodiment, the cutoff element is a thin steel sheath with a wall thickness of, for example of about 0.020 inch and is rectangular in cross-section. The cutoff edge 32 is formed by adjacent sides 36, 38 of the element which have opposing sides 40, 42 respectively, forming the other sides of the cutoff element. The heating element is a resistance wire-type electric heater disposed in an insulating material inside the tube in the manner of commercial available rod-type heating elements.

To provide the desired type of corner edge, the walls of the cutoff element should diverge from each other by at least 30°.

The cutoff element 16 is supported at one of its ends in a bracket 44 at the other end by one wall 46 of a housing 47 having a detachable cover 48. The cutoff element 16 extends through the wall of the housing 46 to project inwardly of the housing and has a thermostat 49, preferably including a bimetal 50 which is mounted directly against the side 42 of the cutoff element 16. The thermostat is held onto the cutoff element 16 by a metal band 52 which clamps the thermostat to the cutoff element and provides efficient heat transfer between the cutoff element and the thermostat.

The wall 36 in which the cutoff 16 is supported has a portion 54 of heat insulating material which has an aperture therein through which the heating element 32 passes. The insulating material 54 supports the cutoff element 16 and prevents heat transfer to the other portions of the dispensing apparatus which are conventionally made of metal.

Figure 3:
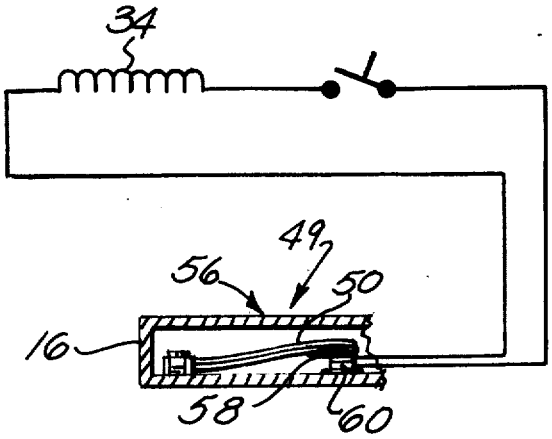
FIG. 3 is basically a diagrammatic view showing the cutoff element and the electrical circuit for controlling the temperature thereof.

As shown in FIG. 3, the thermostat 49 comprises a metal container 56 which encloses the bimetal 50 to assure good heat transfer to the bimetal. The bimetal operates when the temperature of the cutoff element exceeds a setting preferably between 250° F and 260° F to open switch contacts 58, 60 to deenergize the heating element.

One end of the bimetal is mounted to the container so as to have good direct heat transfer therewith by conduction and the other end of the bimetal, which is free, mounts the contact 58, the latter being electrically insulated from the bimetal. The contact 60 is mounted on the wall of container 56 and is insulated therefrom.

When the contacts 58, 60 separate, the heating circuit to the heating coil 34 is broken to prevent the heating element from overheating. However, when the temperature of the cutoff element drops, e.g. as a result of severing operations, this will be sensed by the bimetal and the contacts 58, 60 will close to re-establish the proper temperature at the severing edge.

While a particular thermostat has been illustrated, it will be understood that other types of thermostats may be used within the scope of the present invention but preferably the thermostat has fast response to temperature drops in the cutoff element and the heating ability of the heating element is such that the cutoff element can be quickly brought back to temperature after a severing operation. When this construction is utilized, sheets of film can be severed from the roll at a relatively fast rate and the temperature of the cutoff edge brought back to the proper temperature between each severing. It will be further understood that the amount of heating power available and the response of the thermostat need not be as large or fast when sheets are severed at a rate such that the lower heating power or slower response of the thermostat is sufficient to maintain the element at the proper temperature at the time of severing.

It will be understood that the edge of the cutoff element may be slightly rounded and need not be a line-edge. However, the rounding must have a very small radius so as to concentrate stresses essentially along a line which essentially corresponds to a corner that is formed by the intersection of two substantially planar surfaces.

Rod-type heating elements which are readily obtained from commercial suppliers are readily configurable by the supplier to provide the necessary corner edge so as to function as an internally heated cutoff element. In the practice of the invention for severing polyvinyl chloride film, a 65 watt rod-type heating element having a rectangular configuration has proved satisfactory.

What I claim is:

1. Apparatus for severing sheets of film from a roll of plastic film, said apparatus comprising a cutoff element for severing the film when the film is moved against the cutoff element under tension and a pressure established between the cutoff element and the film, said cutoff element including means defining diverging walls extending at acute angles with respect to the plane of the film as the film is moved thereagainst and defining a corner edge for engaging the film to be severed and for concentrating stresses applied to the film substantially along a line of severance, said cutoff element being made of sheet metal having high heat conductivity, an elongated electric heating unit extending substantially the length of said cutoff element and disposed between said wall portions to effect a heating of said cutoff element including said corner edge, means for electrically insulating said elongated electrical heating unit from said cutoff element, and thermostat means disposed in good heat transfer relationship with said cutoff element to be sensitive to changes in temperature of said cutoff element, said thermostat means including means for automatically controlling said heating element to heat said cutoff element and maintain the temperature of said diverging walls and said corner edge at a temperature lower than the melting point of said film.

2. An apparatus defined in claim 1 wherein said thermostat means operates to maintain said wall portions at a temperature of between about 240° F and about 260° F.

3. An apparatus as defined in claim 1 wherein said thermostat means is a bimetallic switch for energizing and de-energizing said heating unit and means mounts said thermostat means in good heat transfer relationship with the heat conductive material of said cutoff element.

4. An apparatus as defined in claim 3 wherein said bimetal switch is actuated on and off to maintain the walls of said cutoff element at a temperature between about 240° F and about 260° F.

5. An apparatus as defined in claim 1 wherein said cutoff element is a tubular element providing said walls and said heating unit is disposed within said tubular element.

6. An apparatus as defined in claim 2 wherein said cutoff element is a tubular element providing said walls and said heating unit is disposed within said tubular element.

7. An apparatus as defined in claim 3 wherein said cutoff element is a tubular element providing said walls and said heating unit is disposed within said tubular element.

8. An apparatus as defined in claim 4 wherein said cutoff element is a tubular element providing said walls and said heating unit is disposed within said tubular element.

9. An apparatus as defined in claim 5 wherein said cutoff element is rectangular in cross-section.

10. An apparatus as defined in claim 7 wherein said cutoff element is of sheet metal and is rectangular in cross-section.

11. An apparatus as defined in claim 1 wherein said thermostat means is a bimetallic switch for periodically energizing and deenergizing said heater and means mounts said thermostat directly on and in good heat transfer relationship with said walls of said cutoff element.

12. An apparatus as defined in claim 6 wherein the said thermostat means is a bimetallic switch for periodically energizing and deenergizing said heating unit and means mounts said thermostat on said tubular element in good heat transfer relationship with respect thereto.

13. An apparatus as defined in claim 10 wherein said thermostat means is mounted directly on said cutoff element and said walls each define an acute angle of at least 30° with respect to the film.

14. A method of severing polyvinyl chloride film comprising the steps of providing a cutoff element having wall portions defining a corner edge, bringing the plane of the film to be severed into engagement with the cutoff element with the wall portions disposed at acute angles with respect to the plane of the film to concentrate stresses applied to the film substantially along a line of severance, heating the cutoff element by applying electrical power to an electrical heating unit disposed in heat transferable and electrically insulated relationship with said cutoff element, sensing the temperature of the cutoff element with a temperature sensing device which is in heat transferable relationship with said cutoff element and automatically reducing the application of electrical power to the heating unit in response to the temperature of the cutoff element when the temperature sensed by the temperature sensing device reaches about 260°, automatically controlling application of electrical power to the heating element to heat the cutoff element in response to the temperature of the sensing element when the temperature of the cutoff element is below a predetermined minimum temperature which is below 260°, the application of electrical power to said heating unit being capable of heating the electrical heating element to a temperature considerably about 260°.

* * * * *